United States Patent [19]

Morrison et al.

[11] 4,307,554

[45] Dec. 29, 1981

[54] STRUCTURES AND METHODS OF CONSTRUCTION THEREOF

[75] Inventors: Alistair J. Morrison; Gary J. MacDonald; Brian R. Boulton, all of Christchurch, New Zealand

[73] Assignees: Shelter Engineering Limited; Steven Fitzmaurice and Partners, both of Christchurch, New Zealand

[21] Appl. No.: 37,220

[22] Filed: May 8, 1979

[51] Int. Cl.[3] ..... E04G 21/02

[52] U.S. Cl. ..... 52/741; 52/2

[58] Field of Search ..... 52/741, 80, 82, 247, 52/248; 264/32, 45.2

[56] References Cited

U.S. PATENT DOCUMENTS

| | | | |
|---|---|---|---|
| 2,270,229 | 1/1942 | Neff | 264/32 |
| 2,335,300 | 11/1943 | Neff | 264/32 |
| 2,388,701 | 11/1945 | Neff | 52/80 |
| 2,413,243 | 12/1946 | Neff | 52/80 |
| 2,914,776 | 12/1959 | Hotz | 52/2 |
| 3,241,278 | 3/1966 | Magers | 52/248 |
| 3,277,219 | 10/1966 | Turner | 264/45.2 |
| 4,155,967 | 5/1979 | South et al. | 52/80 |

FOREIGN PATENT DOCUMENTS

| | | | |
|---|---|---|---|
| 65657 | 11/1969 | Fed. Rep. of Germany | 52/2 |
| 450685 | 1/1968 | Switzerland | 52/2 |

*Primary Examiner*—James L. Ridgill, Jr.
*Attorney, Agent, or Firm*—Young & Thompson

[57] ABSTRACT

A pneumatically supported structure is constructed by securing a flat sheet of elastic membrane to a foundation, and then stretching the membrane to form the structure by inflating the membrane with air under pressure. During the stretching by inflation, the membrane may be partially constrained by rigid or flexible members. Plastic foam material may be applied to the inner or outer surface of the membrane once the membrane has been stretched, the plastic material being preferably polyurethane. After inflation, the membrane can be further stretched by forcing members within the confines of the membrane, against sections of the stretched membrane. Preferably, the plastic membrane is a sheet of butyl rubber.

12 Claims, 22 Drawing Figures

STRUCTURES AND METHODS OF CONSTRUCTION THEREOF

Figure 2:
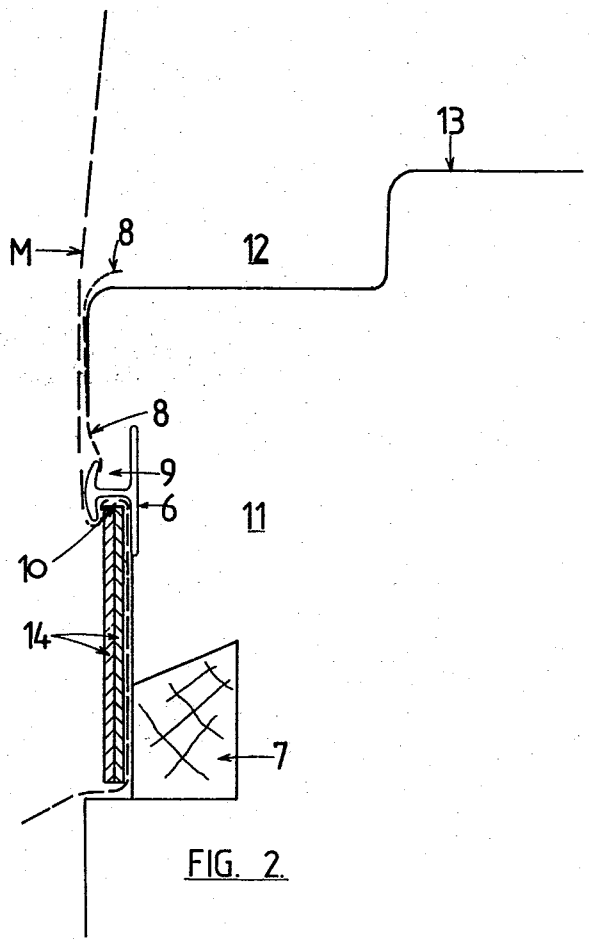

This invention relates to structures and methods of construction thereof.

It is known to provide a pneumatically supported flexible membrane to form a structure such as a building. It is also known to use such a supported membrane to form the basis of a rigid structure.

In both cases the membrane is supported by air pressure and in the following description, whilst reference to air supported structures will be made, it should be remembered that a suitable gas could also be employed.

Historically, air structures may be categorised as one of the following:

(1) Air supported—a space-enclosing, cut and shaped membrane anchored to the ground and tensioned by an internal air pressure so as to support applied dead and live loads;

(2) Air inflated—a self-enclosed, cut and shaped membrane inflated with air to form a stiff structural member capable of transmitting applied loads to its points of support;

(3) Composite—hybrid structures involving (2) above and a rigid framework to which the air structure is anchored and to which applied loads are transferred.

The above named structures entail the cutting and fabrication of various membranes to form the developed shape of the final structure.

According to these known air structures the membrane has not been required to stretch as a result of the applied air pressure and in fact any stretching which has occurred has been of little consequence. Usually any stretching is undesirable as it alters the desired final shape of the structure.

The present invention, however, provides a method of construction of a pneumatically supported structure where the membrane is permitted to stretch either to form the structure itself or to be stretched when the basic structure has been formed.

This specification describes a structure or part of a structure which is formed by stretching a plane elastic membrane or a partially preformed elastic membrane to create a singly or doubly-curved surface in space. Prior to the membrane being stretched it is secured to a foundation, which may be of regular or arbitrary plan shape, by means of anchorages.

If desired, the membrane may be partially constrained during stretching by rigid members, or flexible members (for example cables), or a combination of either one or both of the aforementioned.

The result is a structure of a somewhat complex but attractive shape which would be difficult to achieve by a preformed cut and shaped membrane. This could also be achieved by having an elastic membrane which is not of homogeneous or uniform elasticity. For example, the membrane may have sections or fixtures of rigid material or be of the same or different materials in varying thicknesses.

After the initial pneumatic stretching, the membrane may be further shaped by forcing rigid members, or flexible members, or a combination of either one or both of these, against sections of the stretched membrane. This is of considerable advantage when the stretched membrane is to form the basis of a rigid construction. Such members may be formers placed in positions where doors, windows and other structural fixtures will be required in the final rigid structure, or may be the door frames, window frames, and other fixtures themselves, held in position and suitably braced.

While being maintained in its substantially stretched shape, the membrane may then have applied to it, either internally or externally, at least one coat of a rigid material.

After the membrane has been stretched and the one or more coatings of rigid material applied, the membrane and the means of anchorage thereof may be removed wholly or in part, or the membrane may be retained as an integral part of the completed structure.

Broadly therefore, the present invention provides in one aspect a method of constructing a pneumatically supported structure wherein an elastic membrane is secured to a foundation and then inflated said membrane either stretching to form the structure or being stretched once the basic shape of the structure has been achieved by inflation thereof.

According to the second broad aspect of the invention there is provided a method of building construction wherein a structure according to the foregoing aspect is formed and then covered internally or externally with at least one coating of a rigid material.

Figure 1A:
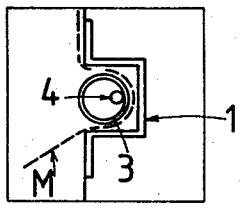
Figure 1:
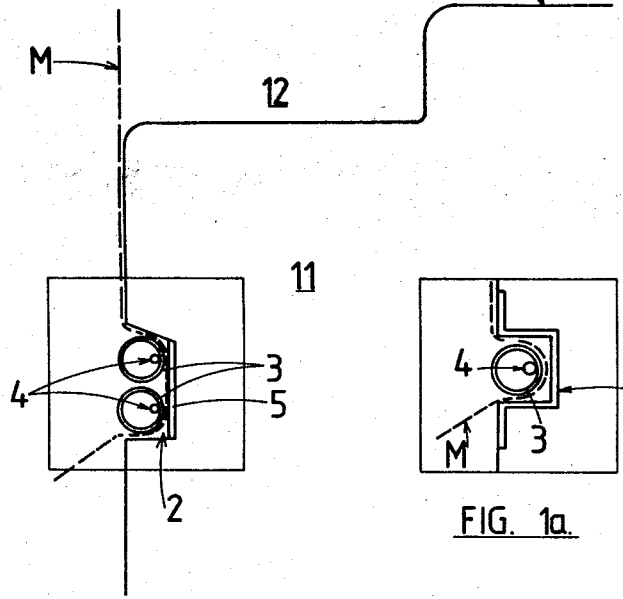
Figure 3:
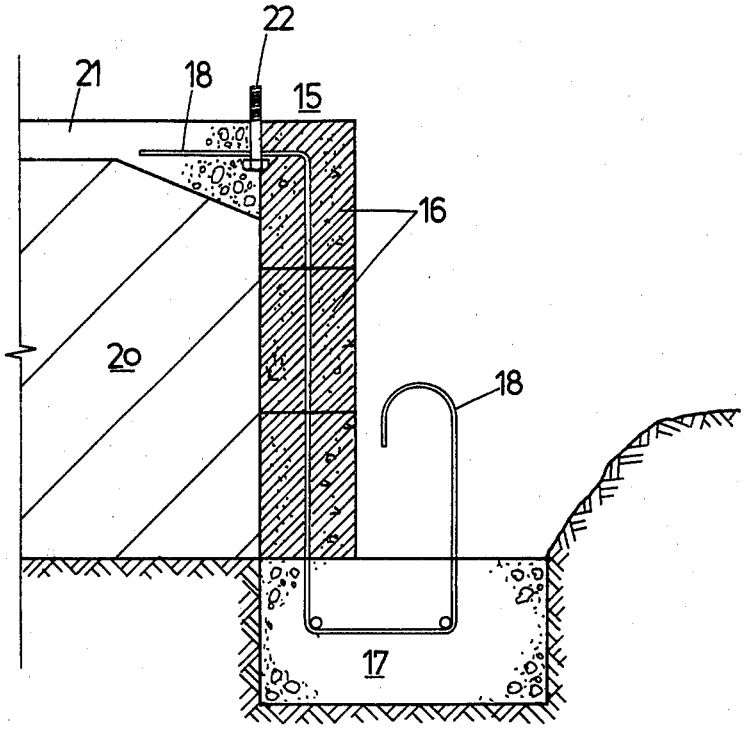
Figure 3A:
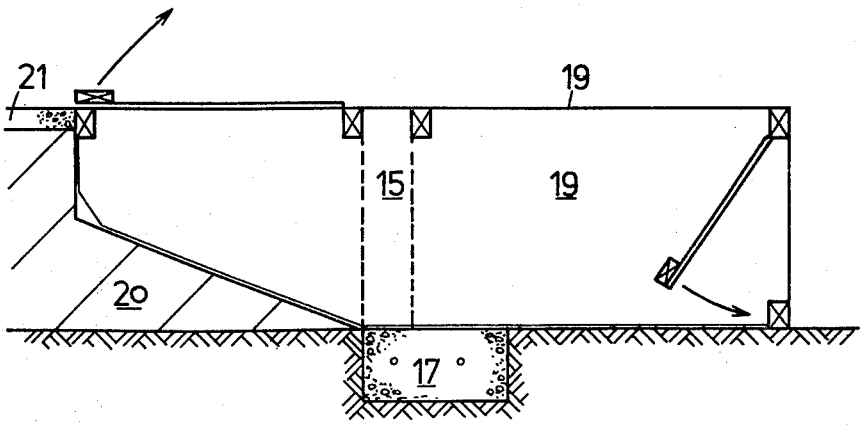
Figure 4:
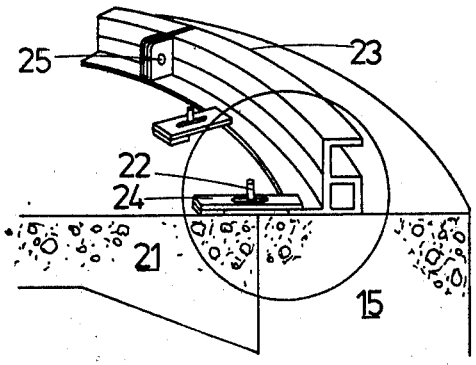
Figure 4A:
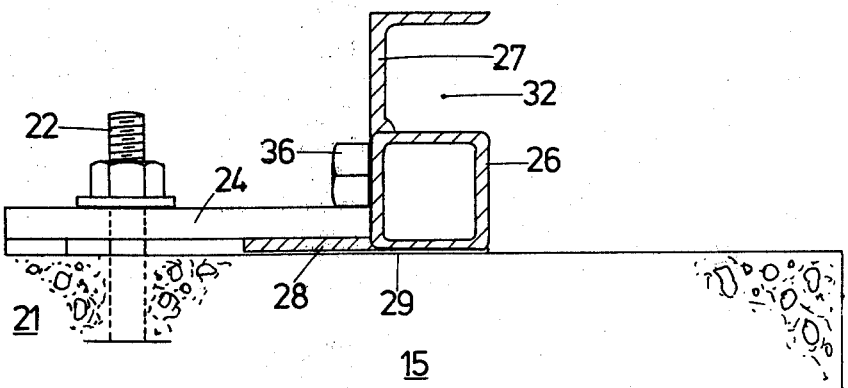
Figure 5:
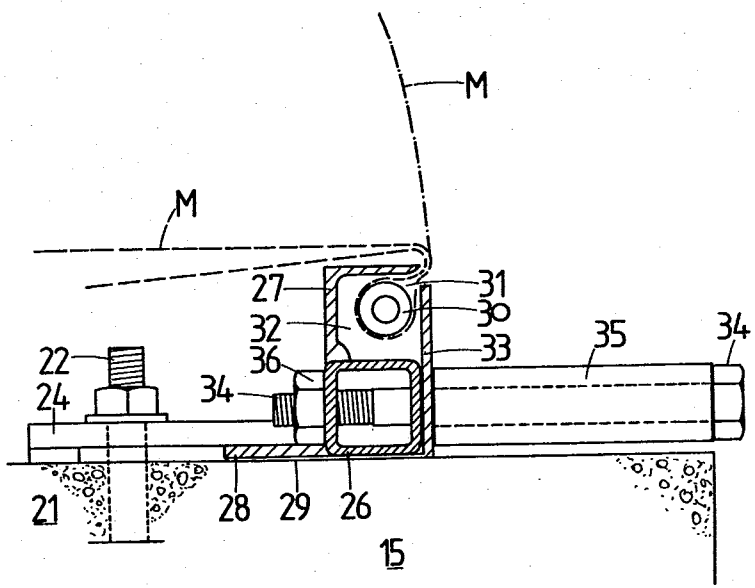
Figure 6:
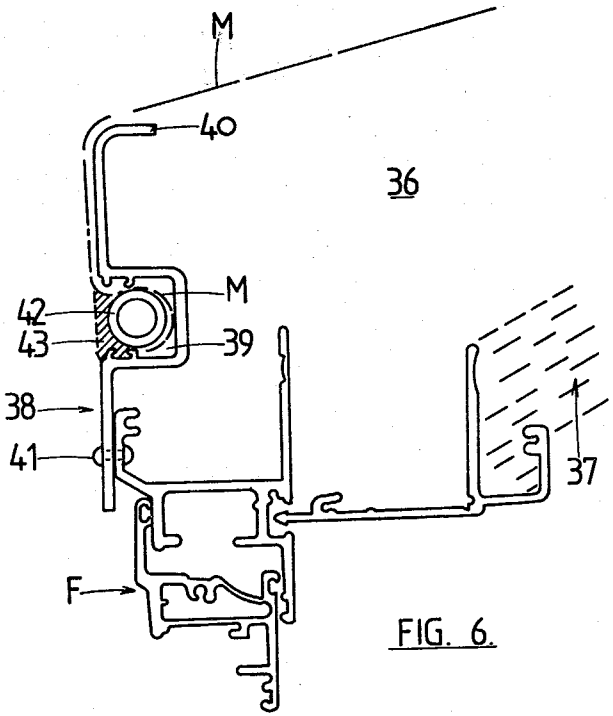
Figure 8:
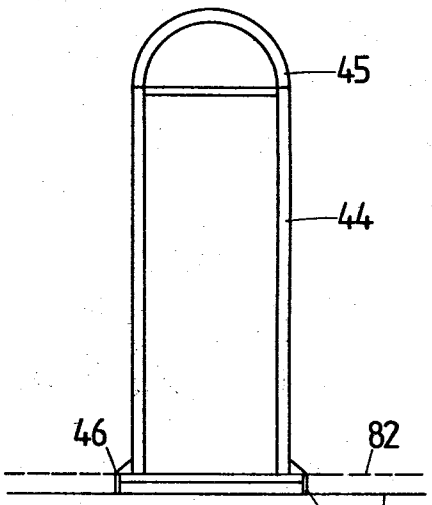
Figure 8A:
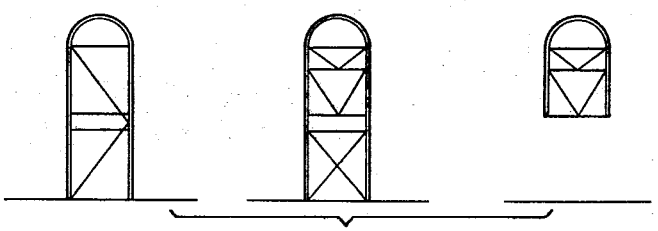
Figure 7:
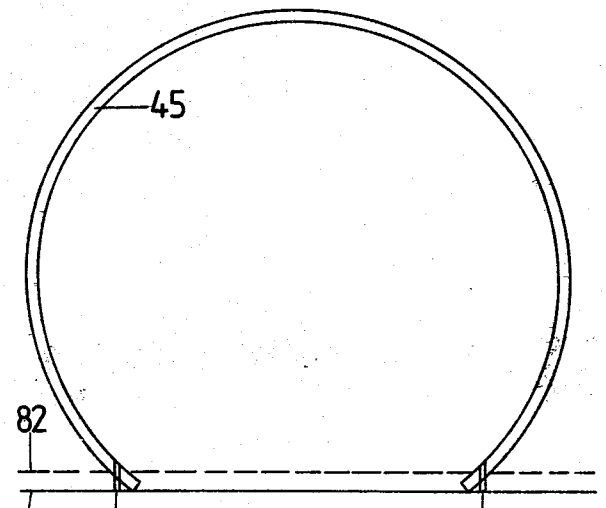
Figure 7A:
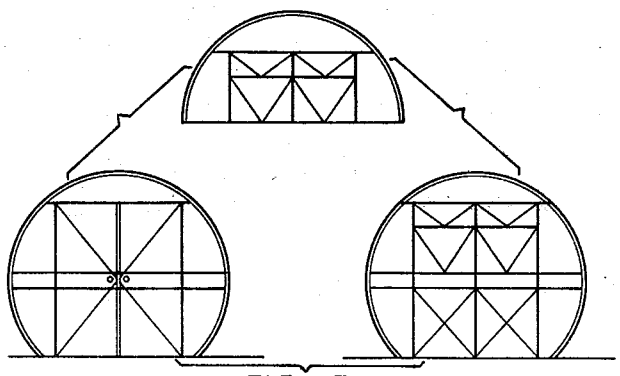
Figure 9:
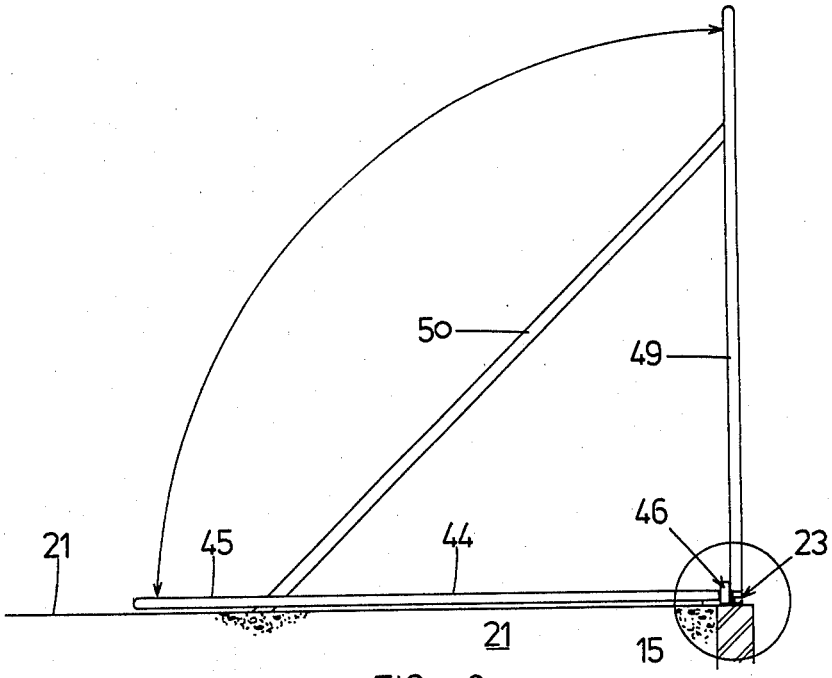
Figure 9A:
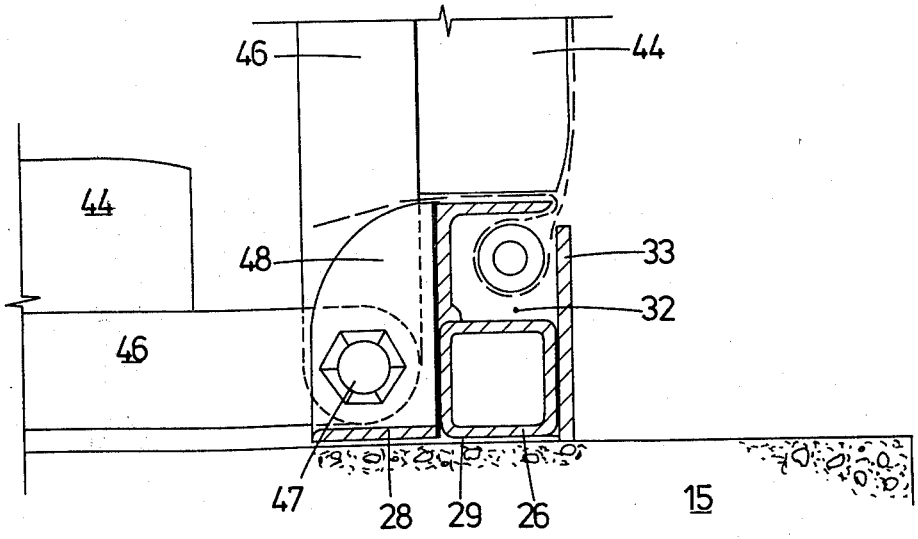
Figure 10:
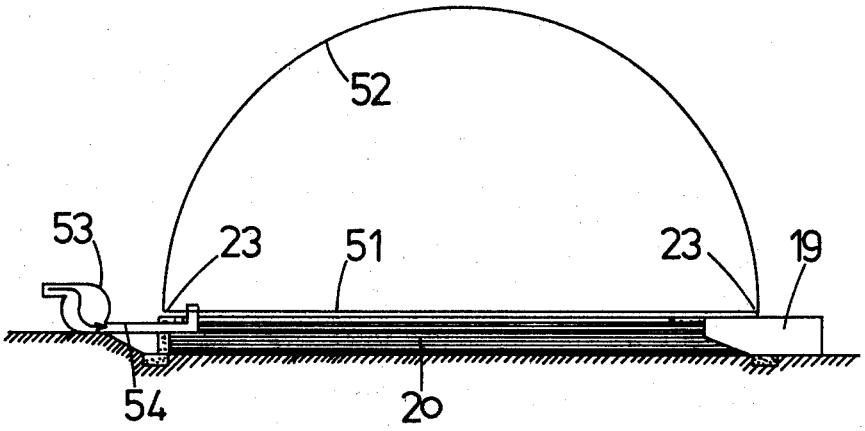
Figure 11:
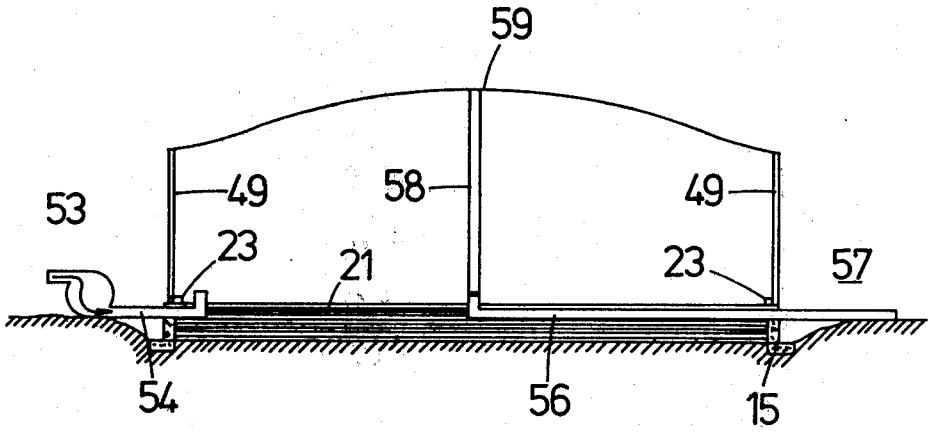
Figure 12:
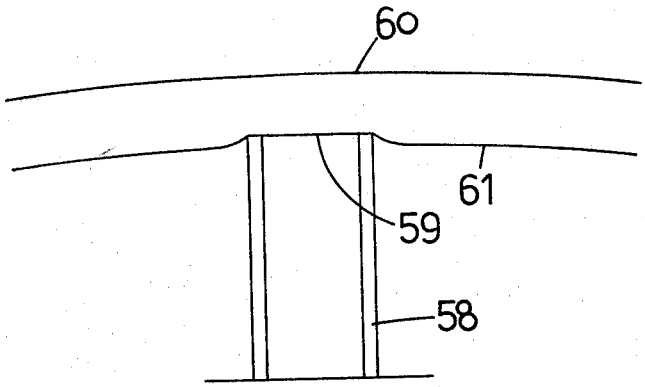
Figure 13:
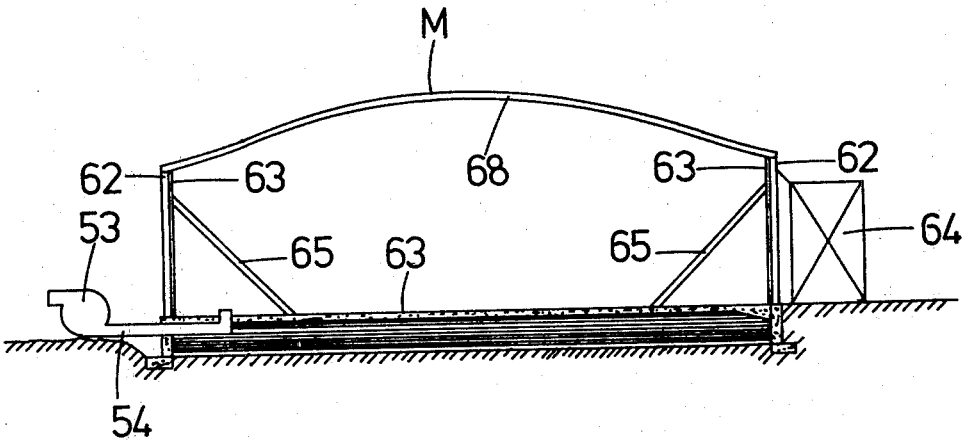
Figure 14:
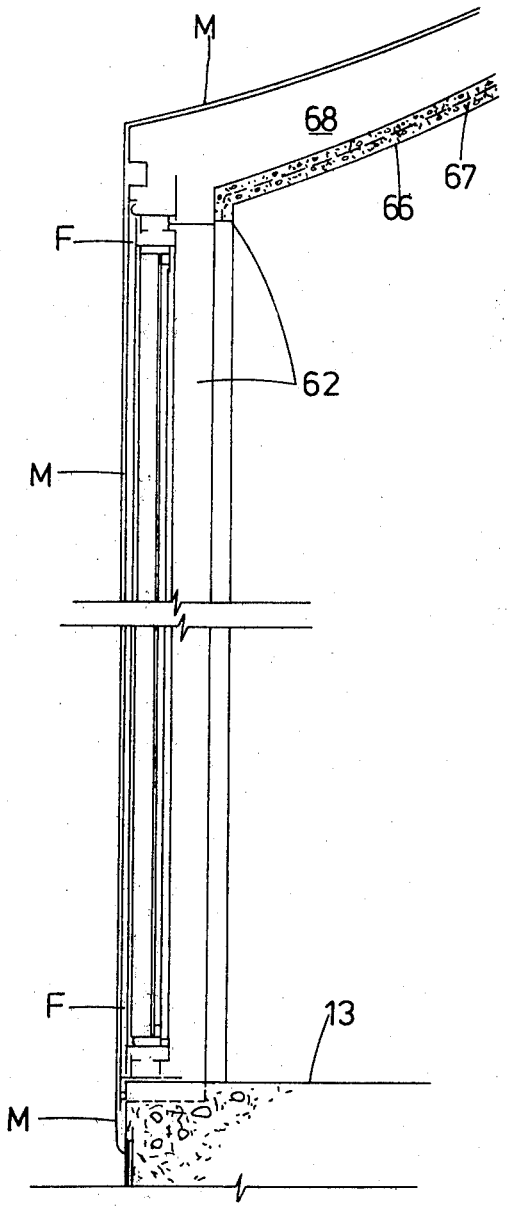

In the following more detailed description reference will be made to the accompanying drawings in which:

FIG. 1 is a sectional elevation view of a means of attaching the membrane to a foundation, FIG. 1*a* is a detail view of the boxed portion of FIG. 1 but showing a modified form of the attaching means, FIG. 2 is a similar view to FIG. 1 but showing a further form of attaching means, FIG. 3 is sectioned elevation of part of the structure foundation, FIG. 3*a* is a sectioned elevation of the foundation with an airlock arrangement, FIG. 4 is a perspective view of a still further form of membrane attaching means, FIG. 4*a* is a detail view of the circled portion of FIG. 4, FIG. 5 is a further detail view of the attaching means of FIGS. 4 and 4*a*, FIG. 6 is a partial view in section of a window or door opening frame and means for attaching the membrane thereto, FIG. 7 is an elevation view of a door or window former, FIG. 7*a* is elevation views of the former of FIG. 7 showing different door and window configurations, FIGS. 8 and 8*a* are similar to FIGS. 7 and 7*a* but showing a different embodiment of door and window former, FIG. 9 is a side view of the door and window former in place on the structure foundation, FIG. 9*a* is a detail view of the circled portion of FIG. 9, FIG. 10 is an elevation view of the membrane in an inflated state, FIG. 11 is similar view to FIG. 10 but showing the formers in position and a height maintenance system, FIG. 12 is a detail view of part of the height maintenance system, FIG. 13 is a further elevation view of the structure, FIG. 14 is a sectioned view of the structure showing a door or window fitting.

Figure 15A:
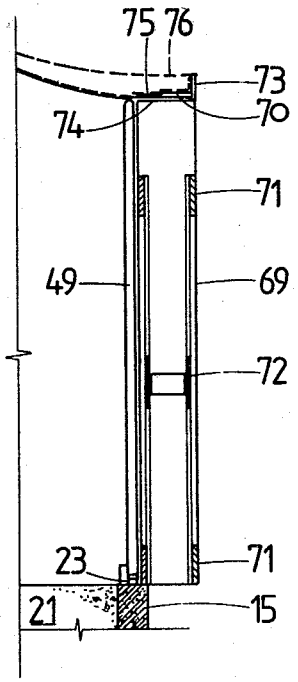
Figure 15:
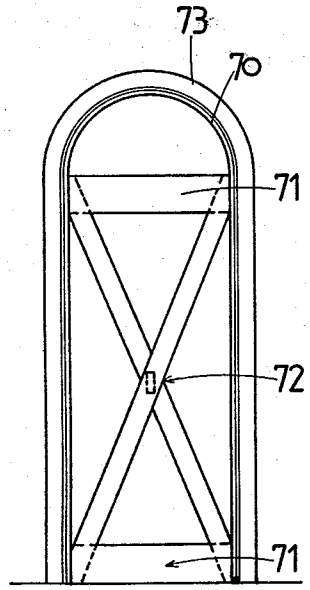

FIG. 15 is an elevation view of an exterior window and door former

Figure 16:
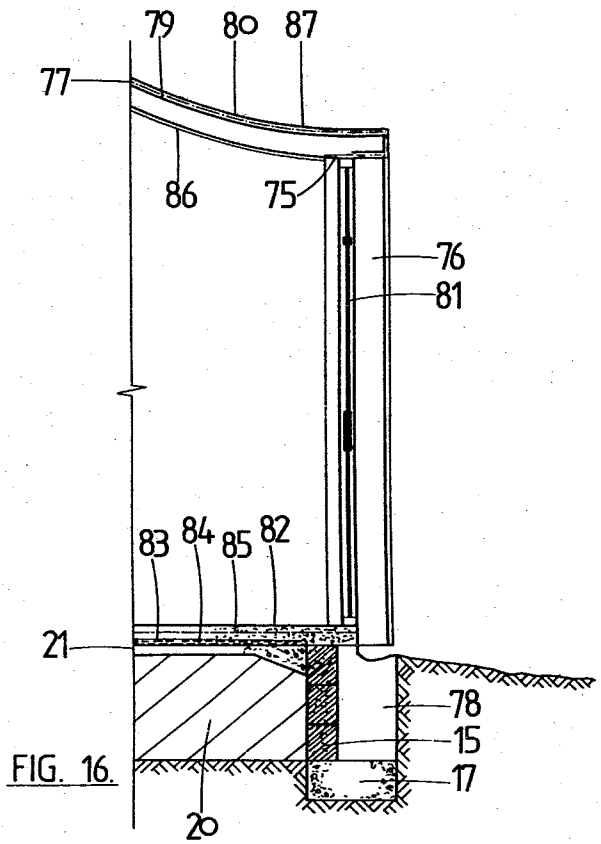

FIG. 15*a* is a sectioned side view of the exterior former in place in the structure, and FIG. 16 is a similar view to FIG. 15*a* but showing details of the finished structure.

While the concept of a grossly stretched plane membrane is common to both the methods described below, they differ in that one method requires the membrane to remain as an integral part of the completed structure whereas the other method allows for the membrane and various fastenings to be removed for subsequent reuse. Insomuch as the methods differ in several important details, these differences will be identified in the description and drawings.

Essentially, the membrane is the most important part of the structure described herein. Preferably, a highly elastic membrane is employed in the construction, and in the preferred form, is fabricated from sheet butyl rubber, an example of which is "Butynol" (R.T.M.).

In many instances, the membrane will be expected to undergo considerable strain; for example, if a hemispherical surface is formed from a plane sheet, the membrane is stretched to approximately 175% of its original length at the apex by the internal pressure. The material specification for Butynol gives an elongation of 300% at rupture (a minimum figure), making this membrane an ideal material choice for the construction method.

The membrane sheet may either be planar, with seams where adjacent sheets are vulcanised or otherwise fastened together, or be fabricated as a partially preformed shape.

The dimensions of the membrane will be dictated either by the shape and size of the structure's floor plan (planar sheet) or by the developed shape of the partially inflated structure (preformed sheet).

The end use of the structure to be built will dictate the location of the site and other considerations regarding building services and site drainage. Otherwise, the method of construction described herein imposes no restrictions on, nor requires special considerations due to the site chosen.

In accordance with normal construction methods the site is levelled and excavated such that the finishing floor level will be at the desired level.

The foundations are boxed in a conventional manner except that in both instances they must include means for anchorage of the elastic membrane.

In the first embodiment, wherein the membrane former is to be incorporated in the final structure, two methods of anchoring the membrane are described.

The first such method, to be used only for truly circular oval or elliptical floor plans or foundation walls where there are no flat sides or re-entrant corners, is detailed with reference to FIG. 1.

For curved foundations or foundation walls, the boxing is usually plywood, but could be formed from curved sheet metal. To the boxing, a continuous strip, of dressed timber, plastic or P.V.C. extrusion or formed sheet metal 1 is attached approximately 50 mm down from top finished foundation level so as to form a continuous anchorage rebate 2 in the foundation slab or foundation wall 11 when concrete is poured against the boxing. If desired, the plastic or P.V.C. or sheetmetal strip 1 (in the shape of a "top-hat" section) may be so attached that when the foundation boxing is removed, the continuous strip 1 remains embedded in the concrete to smoothly line the rebate 2 so formed. Anchorage of the membrane (M) is carried out in the following manner. The membrane (M) is spread out over the foundations or foundation walls and the peripheral edge is placed over the rebate so as to finish at least 100 mm below the lower edge of the rebate all round. One or more lengths of a flexible, hollow member, 3, for example a plastic hose, through which is run a continuous strand(s), such as length(s) of galvanised wire 4 are then placed against the membrane in the rebate 2 formed in the foundations.

The wire(s) is (are) then permanently tightened using a suitable tensioning device so as to pull the wire(s), the plastic hose and the membrane securely into the rebate, thus anchoring the membrane against the uplift induced by the pneumatic stretching of the membrane.

As previously stated, the method of anchorage described above can only be used in situations where the continuous reactions created by tensioning of the circumferential strand(s) are substantial and are all directed towards the membrane structure.

The airtightness of the anchorage so described is adequate, but can be improved by sticking foam plastic tape 5, or similar such sealant material, in the rebate 2 prior to seating of the membrane and the plastic hose, against which the membrane is pressed and sealed when the circumferential wires are tensioned.

The second such method of anchorage is more universal in application and may be used for any shape of floor plan or foundation wall, including those of circular, oval or elliptical shape and those with flat sides and re-entrant corners.

The upper-most boxing member is dressed on one side, or is smooth surfaced such as on plywood or sheetmetal, to provide a suitable surface for fixing of the membrane anchorage. Referring to FIG. 2 a plank of polystyrene (not shown) is inserted by one edge in the groove 10 of a substantially H section jointing strip 6 and then nailed through a nailing strip 7 to the dressed boxing. The jointing strip 6 is located approximately 50 mm down from the floor level of the dressed boxing. Plastic tape 8 is then used to grout proof the top edge of the strip 6 so that concrete 11 fills the top groove 9 but does not drip down the front face of the anchorage.

The concrete 11 is then poured and a recess 12 is left at the outer edge of the floor 13. This recess 12 is provided to accommodate the thickness of the polyurethane wall which will subsequently be formed. Once all concrete work is finished the boxing is stripped and the thin polystyrene plank is removed from the jointing strip 6. The membrane (M) is laid over the foundation and the peripheral edge is placed over the jointing strip 6 in the manner shown in FIG. 2 so that it passes through the lower groove 10 and down the face of the foundation to locate over the nailing strip 7. A timber wedge which in the illustrated form is composed of two sheets 14 of plywood is inserted over the membrane (M) with its upper edge located in the lower groove 10 of the jointing strip 6. This timber wedge 14 is nailed to the nailing strip 7 so locking the membrane (M) in position.

Pleats can be taken in the membrane to take up any excess material such as on the corners, but experience has shown that a better result is obtained by taking small pleats.

In the second embodiment, where the membrane and the various anchorage fastenings are to be retrieved for reuse, the means whereby the membrane is anchored to the foundations are designed so as to be capable both of being fitted from outside the structure before membrane inflation, and also of subsequent removal from the building without damage to the membrane, the achorage fittings, or the partially completed structure.

With reference to FIG. 3, a foundation wall 15 is formed from either filled concrete blocks 16 or poured concrete founded on a conventional reinforced concrete foundation beam 17. Steel starter rods 18 are positioned as shown around the building periphery. A hole of suitable dimensions must be allowed in this foundation wall for the entrance manhole and airlock 19.

The purpose built airlock 19 is fitted into position through the foundation wall, 15, if possible at the location of the proposed watercloset for residential buildings.

The foundations are backfilled 20 as required and compacted to conventional standards. At least 50 mm thickness of site concrete 21, thickened at the foundation wall 15, is poured on the compacted backfill and screeded level.

Starter rods 18 from the foundation wall 15 are bent through the side of the concrete blocks 16 into the site concrete floor, and hold-down bolts 22 are placed in the floor approximately 150 mm from the foundation wall 15 exterior surface at pre-determined peripheral intervals.

When the site concrete floor 21 has attained sufficient strength and with all the hold-down bolts 22 in their proper location, the purpose built holding-down beam 23 is fitted into position some 75 mm (urethane wall thickness) from the outside edge of the foundation wall, as shown in FIG. 4, and bolted in placed using the aforementioned hold-down bolts 22 and flat bar clamping members 24. The continuous holding down beam 23 comprises a certain number of standardised sections, bolted together, each section being prefabricated from an RHS member 26, an angle member 27, and a flat bar member 28, with steel being the preferred material, although nonferrous sections such as aluminium may be used. The beam 23 should be seated on foam plastic 29, or a sealant strip, to make the structure airtight against the foundation concrete and over the airlock.

The membrane is continuously anchored around the foundation wall by following the procedure described hereunder with reference to FIG. 5.

The membrane sheet (M), which may be either essentially planar or partially preformed to the desired final shape, is placed over the previously prepared foundations. A flexible member 30, for example thick wall rubber or plastic hose, of at least diameter 10 mm, is placed in a fold 31 of the membrane (M) and tucked into the U-shaped space 32 formed by the angle on the hold-down beam 27 and the RHS 26. This action is repeated around the circumference of the building.

The membrane (M) and flexible member 30 contained in the fold 31 are anchored in position by the restraining action of curved flat bar members 33 (of the same curvature and lengths as the hold-beam sections) which are bolted to the hold-down beam 23 by anchor bolts 34 which pass through a pipe sleeve 35, the flatbar member 33, and the RHS 26 before engaging a nut 36 prewelded to the inside of the hold-down beam 23.

The pipe sleeve 35 must be at least as long as the intended final thickness of the foam to be applied to the outside surface of the membrane, in order that the anchor bolts 34 and sleeves 35 may be removed before the final surface finishing of the structure.

The method described above enables the membrane to be placed in position and anchored to the foundation entirely from outside the uninflated structure. Furthermore, after the structure is formed and the first or subsequent rigid coatings applied, the anchorage components and the membrane sheet can all be dismantled and retrieved, with the exception of the hold-down bolts 22 which further serve to anchor the finished floor slab to the site concrete floor 21.

In order to allow for entrance to the structure while the membrane is being inflated or is being maintained at the desired shape, an air lock must somehow be provided.

In the first embodiment, where the membrane is to be permanently in position, a purpose-built air lock is positioned where, in the final structure, a doorway or large full height window will occur, and flaps joined to the parent membrane are nailed to battens around the interior air lock door frame. An airtight transition section is so formed. An operator then enters the air lock and cuts an oval hole in the membrane through which entrance is effected.

In the second embodiment, because the membrane is to be removed for reuse, it is more practical to incorporate the airlock in an entrance manhole formed in the foundation wall (FIG. 3) through which building services can eventually be run.

Although the airlock ensures ease of personnel entrance to the inflated structure, building materials and components such as window and door frames and formers cannot be carried through the airlock because of its limited size.

Therefore, such materials and components are as required inside the structure during inflation, stretching and foam spraying should be placed and/or secured before the membrane is spread over the foundations and anchored around the periphery.

In the first embodiment, conventional aluminium doors and window frames are themselves used as the rigid members forced into the stretched membrane to deform the membrane to the desired shape at the location of door and window openings.

The door and window frame sections are modified by the addition of a facing member (see FIG. 6) which keeps the membrane clear of the frame by about 100 mm or so, regardless of the angle at which the membrane meets the door or window frame, so that, for instance, 75 mm of polyurethane 36 and 25 mm thickness of concrete 37 can be placed around the door or window to give additional strength.

The facing member 38 is substantially planar with a longitudinal groove 39 formed therein. The upper arm of the member 38 is preferably formed with a return 40. The lower arm of member 38 is fastened by mechanical fasteners 41 to the normal frame indicated by F. The groove 39 is provided for the free end of the membrane M to be inserted and flashed after the member is cut to provide the window opening.

Preferably, the door and window frames should be pre-glazed to afford maximum stiffness to the frames themselves.

The modified door and window frames are then attached to timber or metal tilt-up support frames which are laid flat against the floor under the membrane until it is inflated. Props are prefabricated and fitted to the door and window support frames so as to locate and hold the doors and windows in their required positions vertically above the floor when the frames are tilted into position.

In the second embodiment, the stretched membrane is deformed to the desired shape at the location of door and window openings by the use of purpose-built door and window formers, which are preferably of two standardised shapes and sizes, but within which shapes several different door and window configurations may be fitted in the final structure.

The two shapes for the door and window formers, and the possible arrangements of doors and windows within these formed openings are shown diagramatically in FIGS. 7 and 8.

Referring to FIG. 9, the formers, which are fabricated from straight 44 and rolled 45 hollow pipe sections welded at the base to flat bar extension pieces 46, are pivoted from the hold-down beam 23 with two pivot bolts 47 which pass through the extension pieces 46 and two stiffener plates 48 welded behind the hold-down beam 23.

The pipe formers 49 are located and fixed in their correct places around the circumference of the foundation, preferably at standardised intervals, in their lowered position under the membrane against the site concrete floor 21, until the structure is inflated and stretched.

Props 50 are fixed to the rear of the pipe formers so as to locate and hold the formers in their required vertical position once the membrane is inflated and the formers are tilted up into position against the stretched membrane.

The difference between the two methods of fixing doors and windows as described above is that the first method requires that the door and window frames are incorporated directly into the structure as the foam coating is applied to the interior membrane surface, wherein the second method requires that the frames are fitted and flashed into a prefromed opening after the foam application to the exterior membrane surface is complete i.e. the sequence similar to conventional construction methods.

Having now described the form, the preparation, and the construction of the foundations, the anchorage systems, and the door and window openings required for the creation of the stretched membrane structure, the actual mode of formation will be detailed as an ordered sequence of events.

According to the methods already described, and in the preferred form, a rigid base of any shape is provided and can be, for example, a foundation beam, a floor slab, or a wall.

Door and window formers of the preferred type are then fixed in their collapsed positions at intervals around the foundation periphery and the aforementioned membrane is spread over the top of the foundations and the affixed former members, leaving sufficient overhang for effective anchorage to be achieved.

The membrane is securely fastened to the base so as to achieve a reasonably airtight, position anchorage, using whichever one of the methods described above is relevant or preferred. With reference to FIG. 10, the flat membrane 51 is then stretched 52 by inflating with gas. In the preferred case, inflation is conveniently carried out by standard domestic vacuum cleaners 53, in the blower mode of operation. These can be coupled temporarily to services (water, sewerage, electrical) pipes or conduits 54 embedded in the concrete foundation and communicating with the inside of the membrane.

If the membrane is to remain on the structure (i.e. the first embodiment), the air lock may be positioned in place while inflation and stretching are in progress, and flaps of membrane welded to the parent sheet are nailed to battens around the interior door frame of the airlock to form an airtight transition section. When the membrane is sufficiently inflated, an operator may enter the airlock and cut an oval hole in the parent sheet to give entrance to the interior of the stretched structure.

In the second embodiment where a reusable membrane is stretched, the airlock in purpose built and fits into a space in the foundation, therefore requiring no special attention while inflation is in progress. It should be noted that this type of airlock may also be used in the first embodiment, where the foundation wall is of suitable form. At this stage it is recommended that an operator enter the structure and check the membrane for any pinholes or tears which may have occurred during the anchorage and stretching operations. Any flaws so found should be marked and patched before any further work is carried out.

The membrane is sufficiently overinflated to allow for the window and door frames or formers (whichever are being used in this instance) to be swung up into position manually. The amount of overinflation required to install the frames or formers depends on the floor plan size and shape, and the shape of the window and door frames or formers. In one form, the frames or openings can be circular arcs or be rectangular with semi-circular tops (as in FIGS. 7 and 8) so that the acute stress concentrations caused by conventional square corners are overcome. Such curved windows and doors will have their highpoints approximately 2400 mm above finished floor level.

The frames or formers are pushed up into position and the props are located against stops so as to maintain the frames or formers in a strictly vertical plane.

Once the above steps have been carried out, the membrane over-inflation is reduced until the stretched shape attains the desired form and appearance. Such shape is then maintained by means of an air vent/height maintenance system 55—see FIGS. 11 and 12.

Because the inflation pressure is relatively low and the membrane stretch is affected by environmental factors such as temperature and wind, a shape maintenance system based on a constant pressure would not be satisfactory.

The preferred system, with reference to FIG. 11, comprises a 100 mm (say) pipe 56 extending through the concrete slab 21 and foundation wall 15 to free air outside 57, into which is sealed a vertical pipe 58 of the same diameter, and of a height such that the membrane just touches the rim 59 when the desired form is achieved.

In operation, if the inflated volume is too great and the shape is too high the membrane 60 does not seal on the rim 59 of the vertical pipe 58 and air is vented to atmosphere. If the shape is too low (i.e. too little inflated volume), the membrane 61 rests on the rim 59 of the pipe 58, sealing the air vent and allowing the inflated volume to increase until air is again being exhausted. As an example of its use, the stretched and deformed membrane may first be covered with a lightweight foamed material e.g. polyurethane, foamed concrete, on either the inside (first embodiment) or the outside (second embodiment) surface of the membrane to give a rigid, thickened structure of the same shape as the inflated membrane. This operation may be followed by the application of one or more further layers, being either structural or finish coatings, to both the inside and outside surfaces. That is, the pneumatically stretched membrane is used as singly or doubly-curved form-work in the construction of a rigid structure.

A description of the typical construction of such a structure is given below with reference to FIGS. 13 to 16. It considers, firstly, the application of polyurethane, concrete, plaster, and finish coating system to a permanent membrane structure, and secondly, the application of the same materials where the membrane is reuseable and is removed at some stage in the construction.

In the first embodiment, the foam is applied, in spray form, to the inside of the stretched membrane whereupon it expands rapidly to form a thick layer, which becomes more rigid on the curing. The thickness of each layer is governed by the rate at which the sprayhead passes over the surface, and may be controlled within reasonably close tolerances by a skilled operator.

The final foam thickness achieved by several passes of the sprayhead, is determined by the designer, and may depend on structural strength, building use, building size, insulation properties and requirements, to name but a few. In general, the thickness of the foam will be from 75 mm (at the building apex to 150 mm (at openings and foundations).

Care is taken to ensure that the foam fills the extruded door and window frame members 62, and that such members and the floor are all masked 63 against foam overspray.

When spraying of the foam is complete, the air supply 53 inflating the building is then turned off and the airlock 64 may be removed to allow more ready access to the structure. It is recommended that the propping members 65 is retained in place behind the door and window frames as the membrane and fresh polyurethane may tend to creep inwards.

As soon as possible, a structural coating of a cementitious material 66, reinforced with wire, steel or fibres, or a combination of these 67 is applied to the interior surface of the cured polyurethane 68. Prior to concreting or plastering, the polyurethane around the doors and windows is cut as required with a knife, and smoothed off with a rotary rasp, for example, to leave space for the concrete or plaster to be keyed into the door or window frame 62 FIG. 14.

Once the foam and structural layers have been applied, and have reached sufficient strength, the propping members may be removed, as may the material used for masking the door and window frames and the floor.

The exterior membrane (M) is cut in around the doors and windows and the peripheral edge located in the groove or recess 39 of member 38—see FIG. 6. The membrane (M) may be glued into the groove and a proprietary compound 43 such as Ureflex (R.T.M.) can be used to flash the membrane in the groove. As an alternative, the membrane may be wedged in the groove, with, for example, a length of flexible hose 42, and the remainder of the recess then filled with Ureflex 43.

With a structure according to the present description there are many possibilities as to what material layers can be used, though in the preferred form the outside layer should be the waterproofing coat and is thus provided by the membrane. The next coat can then be insulation so that the third layer, the structural coat, inside the insulation is in a stable environment and not subject to extremes of heat and cold so keeping the expansion/contraction at a minimum. This structural coat will also form the fireproofing coat for the insulation.

The membrane can be painted with a bitumen based paint followed by any acrylic to change its colour. If protection of the membrane against permanent physical damage is required a thin coat of fibre reinforced concrete could be applied to the external surface or parts thereof. As an alternative some other protective material could be used such as stone aggregate set into a resin glue.

As the butynol sheet forms a vapour barrier on the outside of the polyurethane moisture vapour cannot migrate inward. However, if the internal environment of the structure is humid water vapour may want to migrate outward. This problem could be overcome by spraying a hypalon paint on the polyurethane prior to placement of fibre reinforced concrete.

Once the structure has been completed internal partitioning can be provided as required. The partitions may be provided as full floor to ceiling or could terminate short of the ceiling as may be dictated by requirements.

In the second embodiment, the preferred foam material e.g. polyurethane, is applied in spray form to the outside surface of the stretched membrane.

Prior to the application of the foam, an exterior former 69 must be erected at the positions of doors and windows. This serves to provide a mould against which the polyurethane can be sprayed to form a curved lip of the same shape as the doors and windows. The details of such a former 69 of which there need only be one for each standard shape of window are shown in FIG. 15.

The lip formers may be built from curved plywood strips about 150 mm wide 70 which are bent and stacked on each other before being fastened together. This bent former 69 is then attached to a support frame 71 which is braced in the vertical plane by other members 72, such as 100×25 timber lengths.

On the outside edge of the lip former 69, a 75 mm high vertical member 73, cut from plywood, for example, to the shape of the opening, is attached.

The assembly is free-standing and well braced against sway, and is moved from one opening to another as the foam spraying proceeds.

The ledge of the lip former closest to the membrane 74 is used to support a 150 mm wide strip 75 of sheet metal (thin enough to curve easily) which is incorporated in the lip 76 surrounding the opening when the polyurethane is sprayed onto the lip former. The sheet metal strip 75 lining the inside of the opening surround 76 serves as a fixing and locating member for the purpose built door and window frames.

When the whole surface of the membrane has been covered with an adequate thickness of foam, all the door and window openings have been surrounded with their curved lips, as described above, and the polyurethane has gained sufficient strength, the air blowers may be turned off, and the interior air pressure released.

Entrance to the structure is gained through the airlock, and the props holding the door and window interior formers are released and the formers themselves are lowered to the floor, where they are then removed from the hold-down beam. The hold-down beam itself is then dismantled by removing (FIG. 5) the anchor bolts 34 and their sleeves 35 from through the polyurethane, by undoing bolts 25 joining the beam section together, by releasing the hold-down bolts 22 and removing the flat bar clamping members 24.

It is now possible for the membrane to be stripped from the polyurethane shell, and this is now carried out, carefully, starting at the openings. Finally, the curved flat bar members 33 around the base of the shell structure are removed leaving just the foam shell in position.

Before any further coatings are applied to the polyurethane shell it is supported from within using propping members (say 100×50 mm) capped with 250×20 mm planks. Further rigidity is given to the partially completed structure by temporarily fitting the glazed or, alternatively, braced door and window frames within the curved sheet metal strip lining the openings.

In the preferred form, the exterior surface of the shell is covered with a cementitious material reinforced with steel, chain mesh, wire netting, or fibres or a combination of one or more of these.

Referring to FIG. 16, for example, the reinforcing, comprising chain mesh, netting and No. 8 wire 77, is placed on the outside of the shell, and drainage channels 78 around the foundation wall 15 are boxed and poured with concrete. Two layers of concrete are then applied to the structure. The first layer 79 may be pump applied and must fill to the depth of the reinforcing steel 77. Once the first coat has sufficient strength, the second layer 80 is hand applied to give the required cover to the steel and give form to the final shape. This last plaster coat 80 is finished flush with the sheet metal strip 75 lining the lip 76 over door and window openings.

After the structural shell has gained sufficient strength, the temporary interior props, the airlock, and the glazed door and window frames 81 are removed from within the structure in preparation for the pouring of the final floor slab 82.

As in convention construction, a damproof course 83 is laid over or appled to the site concrete and a 25 mm thick layer of insulating material 84 is overlaid on the D.P.C. The final concrete floor, reinforced with steel mesh 85, is then poured and finished smooth to a thickness of 75 mm 82.

The door and window frames are now replaced in their correct positions and permanently fixed, in a truely vertical position, to the sheet metal strip lining the lipped openings. The junctions between the frames and the concrete finish coat are sealed with a proprietary compound, such as Ureflex (R.T.M.) Because the polyurethane foam on the inside of the structure must be covered with a fire proof coating, it is recommended that the shell interior be entirely plastered with, say, 12 mm thickness of fibre reinforced gypsum plaster 86 which is cut in around door and window frames and finishes up against any partition walls.

Once the structure has been completed internal partitioning can be provided as required. The partitions may be provided as full floor to ceiling or could terminate short of the ceiling as may be dictated by requirements.

As a final step in the construction sequence, it is suggested that the exterior concrete surface be painted, preferably with a 5 coat paint system 87.

What we claim is:

1. A method of constructing a self supporting structure comprising the steps of securing a flat sheet of elastic membrane to a foundation, stretching the membrane to form a pneumatically supported structure by inflating the membrane with air under pressure, maintaining at least most of both surfaces of the membrane exposed during said inflation, thereafter applying to the pneumatically supported structure at least one coating of a plastic foam material, and then applying a layer of cementitious material over the coating of foamed plastics material.

2. The method according to claim 1, and during the stretching by inflation, partially constraining the membrane by rigid members to alter the shape of the stretched membrane from its shape without said members.

3. The method according to claim 1, and during the stretching by inflation, partially constraining the membrane by flexible members to alter the shape of the stretched membrane from its shape without said members.

4. The method according to claim 1, and after inflation further stretching the membrane by forcing members, located within the confines of the membrane, against sections of the stretched membrane.

5. The method according to claim 1, and wherein said at least one coating of a plastics foam material is applied to the internal surface of the membrane once the membrane has been stretched.

6. The method according to claim 5 wherein the plastics material is polyurethane.

7. The method according to claim 5, and removing the membrane after the foamed plastics coating is applied.

8. The method according to claim 5, wherein the elastic membrane is a sheet of butyl rubber.

9. The method according to claim 1, and applying wherein said at least one coating of a plastics foam material is applied to the external surface of the membrane once the membrane has been stretched.

10. The method according to claim 9 wherein the plastics material is polyurethane.

11. The method according to claim 9, and removing the membrane after the foamed plastics coating is applied.

12. The method according to claim 9, wherein the elastic membrane is a sheet of butyl rubber.

* * * * *